US005284459A

United States Patent [19]

Podd, III

[11] Patent Number: 5,284,459

[45] Date of Patent: Feb. 8, 1994

[54] RECREATIONAL APPARATUS FOR PROPELLING TWO PERSONS

[76] Inventor: George O. Podd, III, 70 W. Burton Pl., Apt. 2408, Chicago, Ill. 60610

[21] Appl. No.: 957,237

[22] Filed: Oct. 6, 1992

Related U.S. Application Data

[63] Continuation-in-part of Ser. No. 833,349, Feb. 10, 1992, Pat. No. 5,152,728, which is a continuation-in-part of Ser. No. 383,932, Jul. 21, 1989, Pat. No. 5,087,035.

[51] Int. Cl.[5] ..... A63B 22/00; A63B 71/00

[52] U.S. Cl. ..... 482/51; 482/906

[58] Field of Search ..... 482/51, 74, 71, 124, 482/906, 82

[56] References Cited

U.S. PATENT DOCUMENTS

| | | | |
|---|---|---|---|
| 895,055 | 8/1908 | Spooner . | |
| 1,922,169 | 8/1933 | Martin | 482/82 |
| 3,563,208 | 2/1971 | Nero . | |
| 3,747,929 | 7/1973 | Burke . | |
| 3,752,474 | 8/1973 | Macabet et al. . | |
| 3,810,613 | 5/1974 | Jorwa . | |
| 4,245,839 | 1/1981 | Trent . | |
| 4,256,098 | 3/1981 | Swan et al. . | |
| 4,748,937 | 6/1988 | Musetti . | |
| 4,772,014 | 9/1988 | Rebman . | |
| 4,787,630 | 11/1988 | Watson | 482/71 |
| 5,087,035 | 2/1992 | Podd, III . | |
| 5,167,601 | 12/1992 | Frappier | 482/74 |

FOREIGN PATENT DOCUMENTS

| | | | |
|---|---|---|---|
| 2308752 | 9/1973 | Fed. Rep. of Germany | 482/906 |
| 2305917 | 10/1976 | France | 482/906 |
| 2612787 | 9/1988 | France | 482/906 |

*Primary Examiner*—Stephen R. Crow

*Attorney, Agent, or Firm*—Speckman, Pauley & Fejer

[57] ABSTRACT

A recreational apparatus for propelling two or more persons with respect to each other. A handle is attached to each of opposite ends of an extendable link. The extendable link extends or stretches from an equilibrium position to an extended length upon application of an outward force applied to the extendable link. The outward force has an outward force component directed outward along a longitudinal axis of the extendable link. After release of the outward force, the extendable link returns to its equilibrium position with an inward force. The inward force has an inward force component equal in magnitude and opposite in direction to the outward force component for accelerating a first user with respect to a second user. The recreational apparatus also has a shield mounted around the handle for protecting each user's hands in the event the opposite user intentionally or unintentionally releases the handle when the extendable link is under tension forces.

8 Claims, 8 Drawing Sheets

55
56
57
30
41
60
66
65
50
71
52
70
75
76
80
81
51
91

40
85
86
87
88
89
90

40
42
47
46
45

40
42
46
47
45

40
42
46
45

40
42
45

48
42

42
49

135
136
140
145
146

RECREATIONAL APPARATUS FOR PROPELLING TWO PERSONS

CROSS REFERENCE TO RELATED APPLICATION

This application is a continuation-in-part patent application of my co-pending patent application having Ser. No. 07/833,349, filed Feb. 10, 1992, now U.S. Pat. No. 5,152,7 which is a continuation-in-part patent application of my earlier patent application having Ser. No. 07/383,932, filed Jul. 21, 1989, which is now U.S. Pat. No. 5,087,035.

BACKGROUND OF THE INVENTION

1. Field of the Invention

A recreational apparatus for propelling two persons with respect to each other wherein the apparatus includes an elastic or extendable link and a handle secured to each of opposite ends of the elastic or extendable link.

2. Description of the Prior Art

Swan et al., U.S. Pat. No. 4,256,098, discloses a safety restraint system for ambulatory patients. The restraint mechanism includes a flexible tether or cord attached at one end to a harness or garment worn by a patient. An opposite end of the flexible tether or cord is attached to an inertial reel. The reel is mounted in a track or groove formed in a ceiling of a room or is mounted to an overhead frame. A spring in the reel normally tends to retract the tether to maintain slight tension when it is attached to the patient's harness. If the patient suddenly falls, a centrifugally or hydraulically operated safety mechanism in the reel immediately resists rotation of the reel in an unwinding direction, thereby causing the patient to be lowered gently to the floor. The '908 patent teaches no means for retracting the tether or cord once it is extended from the reel. Thus, a patient that falls to the ground would not use the same mechanism to be lifted from the ground.

Musetti, U.S. Pat. No. 4,748,937, teaches a retractable leash which coils up automatically when no outward force is applied to the handle. Such device is intended to be fixedly attached to the collar of an animal or to the front of a skateboard or surfboard. The leash is made of a high strength cable with means for attachment at one end to an animal collar or to a surfboard or skateboard and means for attachment to a handle assembly at the other end of the cable.

Spooner, U.S. Pat. No. 895,055, teaches an apparatus for supporting roller skaters in a rink. A chain link is attached at one end to a spiral spring. The spiral spring is mounted within a housing which is moveable with respect to a floor of a rink by a trackway mounted from an overhead structure.

Jorwa, U.S. Pat No. 3,810,613, discloses an exercise and weight reduction device having two elliptical channels which have congruent major axes. The elliptical channels are used as tracks. A user of the device places its feet on skates and while grasping hand grips connected to upright support members, moves its feet in the elliptical paths defined by the tracks.

Rebman, U.S. Pat. No., 4,772,014, discloses a physical rehabilitation platform which is used to train a patient to properly walk or run, following an injury. A patient steps or bounces at various angles on panels of a platform while being tethered by a elastic cord.

Macabet, et al., U.S. Pat. No., 3,752,474, discloses a portable exercise apparatus having hand grips attached to opposite ends of a cable for reciprocation during exercise. The hand grips are mounted on a separate cable which is threaded through a pulley.

Trent, U.S. Pat. No., 4,245,839, discloses an exercise device for running in place. The device includes a belt and a single piece of rope. One end of the rope is secured to a fixed object while the other end of the rope is formed into an adjustable belt by a loop forming device.

Burke, U.S. Pat. No., 3,747,929, discloses an apparatus for playing a game. The game apparatus includes hip pads attached to a cord to form a waistband. A swinging striker is attached to a swivel plate which is attached to each player's cord. The striker is used to knock down different colored playing pieces.

Nero, U.S. Pat. No., 3,563,208, teaches a device for maintaining walking children in an organized, supervised group. The device includes an elongated center support member, a plurality of laterally extending crossmembers secured along the length of the center support member. Handles for children to grasp are secured to the distal ends of the crossmembers. The crossmembers are preferably constructed of rope having metal wire reinforcement.

SUMMARY OF THE INVENTION

Due to the interest in the recreational use and the sports of rollerblading and skateboarding, applicant has developed the apparatus of this invention to be preferably used with rollerblades or a skateboard. This invention can eliminate many of the dangers exposed to the user or skater when skating freely in the street.

This apparatus will provide for hours of competition and entertainment in a designated area such as a gymnasium, playground or driveway, and thus will allow the ease of adult supervision.

It is one object of this invention to provide an apparatus for enjoyment or exercise in which two persons can use rollerblades, a skateboard, roller skates, ice skates and the like to self-propel themselves with respect to each other.

It is another object of this invention to provide a recreational apparatus having an elastic or extendable member which extends from an equilibrium position to an extended length position and then back to the equilibrium position.

This invention relates to a recreational apparatus used by two or more persons to propel themselves with respect to each other. At least one extendable link is employed. Each person grasps a handle which is secured to an opposite end of each corresponding extendable link.

In operation, a person on rollerblades, a skateboard or the like accelerates by extending the extendable link from an equilibrium position to an extended length. When the extendable link is exposed to an outward force or tension force, the outward force has an outward force component directed outward along a longitudinal axis of the extendable link. Once the person reaches the limit of elasticity of the extendable link, the outward force is diminished to zero and the extendable link returns to the equilibrium position. During the return, the extendable link exerts an inward force which moves both persons back toward each other. During return of the extendable link means to the equilibrium position, the inward force has an inward force component approximately equal in magnitude to and opposite in direction from the outward force component.

In one preferred embodiment of this invention, the extendable link includes at least one elastic hose, elastic cord or a link commonly referred to as a "bungee cord". It is apparent that the extendable link can include other members capable of stretching to an outer length then returning to an equilibrium position. The extendable link may also include at least one elastic cord and/or at least one helical spring.

Each person grasps a handle which may include a bracket or tubular member each secured to a corresponding end of the extendable link. In another embodiment of this invention, at least one wristband can be used in lieu of the handle shown in the drawings. Each wristband can be secured to a corresponding end of the extendable link.

BRIEF DESCRIPTION OF THE DRAWINGS

The above mentioned and other features of this invention and the manner of obtaining them will become more apparent, and the invention itself will be best understood by reference to the following description of specific embodiments of this invention taken in conjunction with the accompanying drawings, in which.

DESCRIPTION OF PREFERRED EMBODIMENTS

Figure 1:
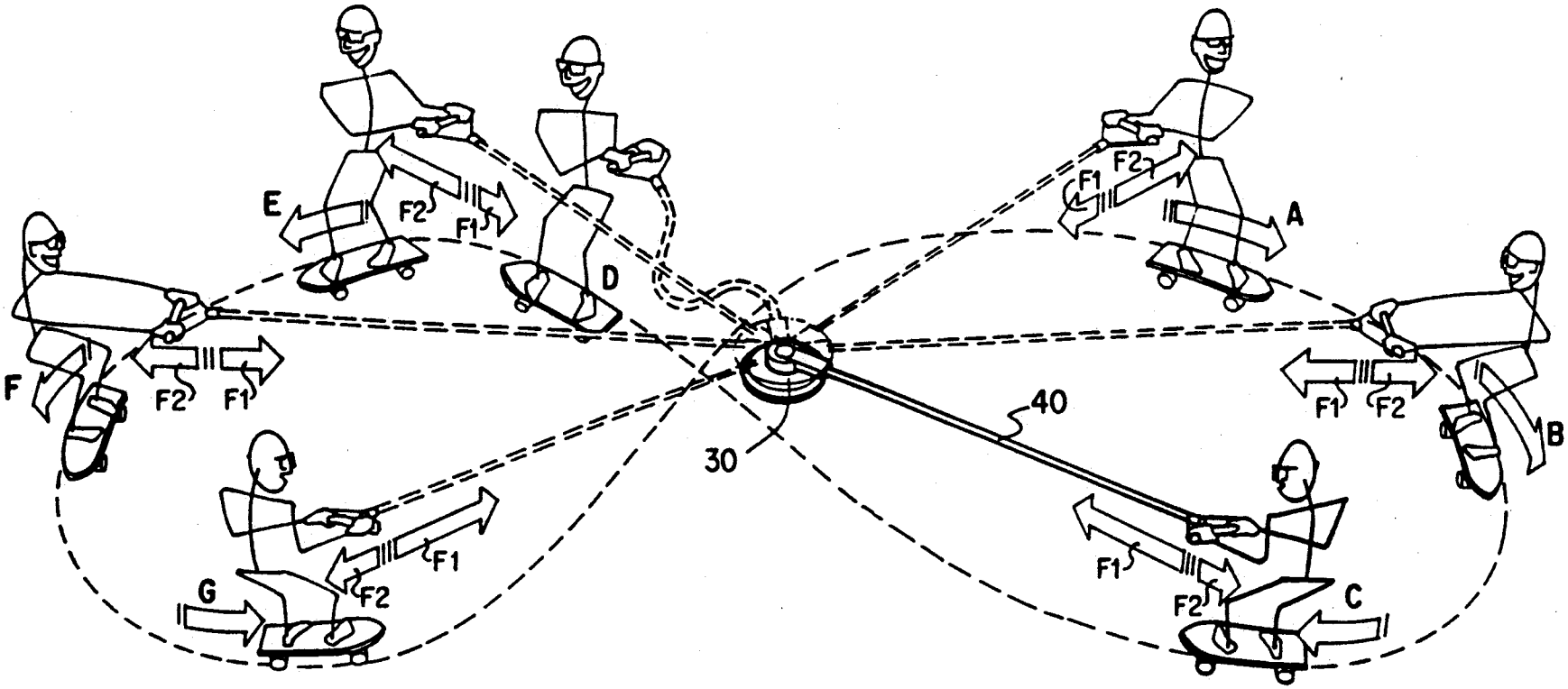
FIG. 1 is a perspective view showing one person in seven different positions throughout a Figure-8 path about a base, according to one preferred embodiment of this invention.

FIG. 1 shows a perspective view of one person using the recreational apparatus, according to one preferred embodiment of this invention. As shown in FIG. 1, the person is traversing about base 30 in a Figure-8 path. At positions A–G, the arrows along the longitudinal axis of extendable link 40 show F1 and F2 which denote the inward and outward forces, respectively, within extendable link 40. At position A, the person moves outward, away from base 30 and thus F2 is greater than F1. At position B, the person decelerates in the outward direction until F1 is equal to F2 and then begins to move inward. At position C, the person is moving inward and F1 is greater than F2 and thus the person begins to accelerate. At position D, the person has reached maximum velocity and begins to decelerate. At position E, the person is moving outward and thus F2 is greater than F1; position E corresponds to position A. Position F corresponds to position B and position G corresponds to position A.

FIG. 1 shows one embodiment of a path which can be used with the apparatus of this invention. It is also apparent that the apparatus of this invention can be used to create a variety of other paths, such as an oval, a loop, and the like.

Figures 2, 3:
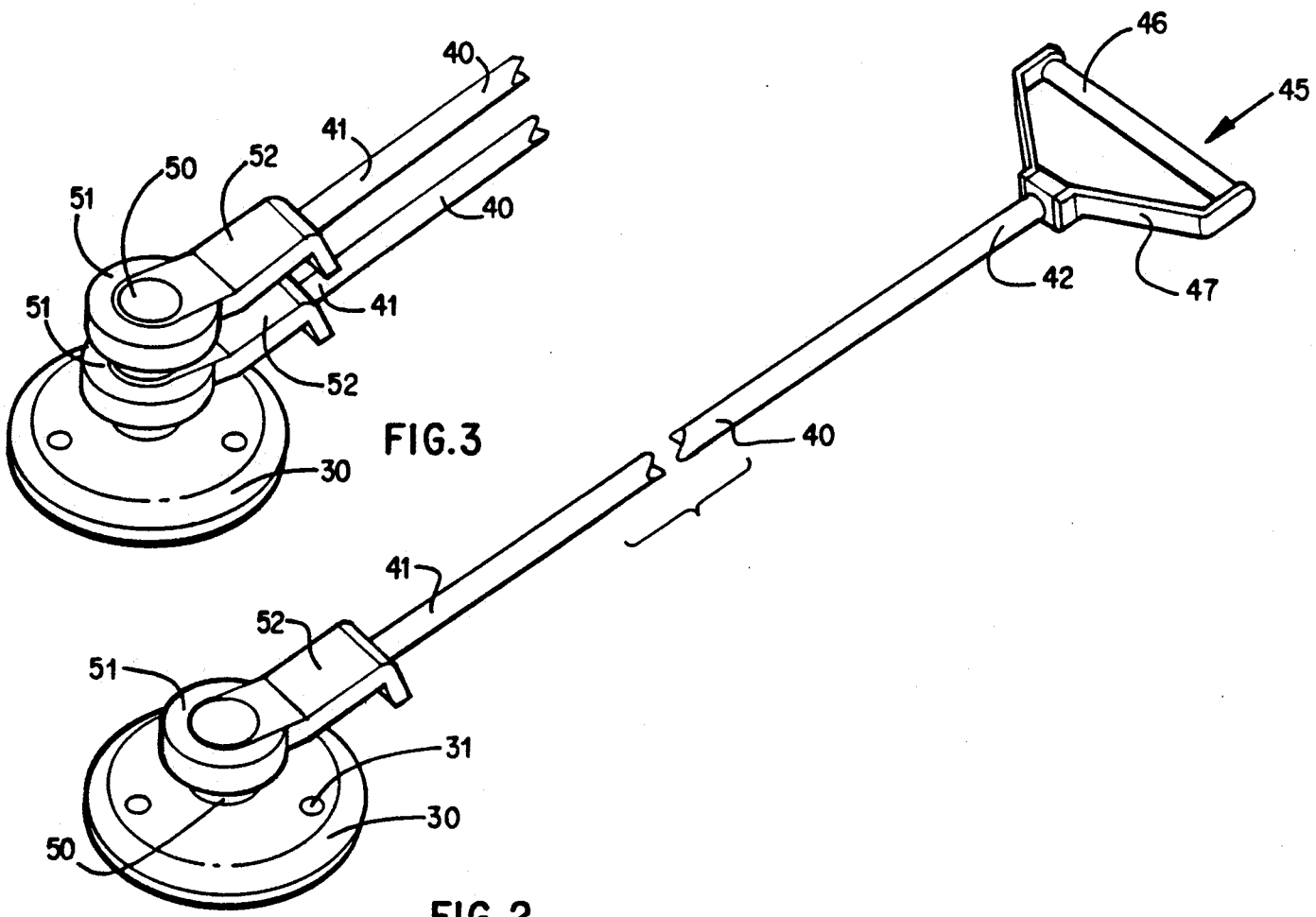
FIG. 2 is a perspective view of the recreational apparatus according to one embodiment of this invention.
FIG. 3 is a perspective view of the base and a plurality of extendable links according to another embodiment of this invention

In a preferred embodiment according to this invention as shown in FIG. 2, the apparatus includes base 30 which is fixed with respect to ground. Throughout this application the term "ground" means any stable structure to which base 30 can be attached. For example, ground may include a driveway, a platform, a stage, a pier in the water, a ceiling, a wall and the like. This invention can be used in a wide variety of environments.

This invention can also be used with various ramps to create a type of course. This invention can be used with skateboards as well as snow boards, surfboards, Boogie boards, skim boards, snow skis, roller skates, rollerblades, ice skates and the like.

Base 30 can be fixed with respect to ground by securing base 30 with bolts, anchors, spikes and the like through mounting hole 31. In other preferred embodiments, base 30 is secured with adhesives, bonding methods, magnets, C-clamps and the like; such methods do not necessarily require mounting hole 31. It is also apparent that base 30 can have internal or external threads for screwing into a fitting or base 30 can be secured with respect to ground in any other suitable method known in the art.

Extendable link means are pivotally attached to base 30. Grasping means for the person to grasp extendable link 40 are secured to an opposite end, grasping end 42, of extendable link 40. The extendable link means extend from an equilibrium position, as shown at position D in FIG. 1, to an extended length, as shown at positions A-C and E-G upon application of an outward force to the extendable link means exerted by momentum of the moving person. The outward force has an outward force component directed outward from base 30 along a longitudinal axis of the extendable link means. Once the outward force is released, at the time the person reaches maximum velocity, the extendable link means returns to its equilibrium position with an inward force. Upon return of the extendable link means to the equilibrium position, the inward force has an inward force component approximately equal in magnitude and opposite in direction d to the outward force component. Throughout this specification and in the claims of this invention, the inward force is said to have an inward force component approximately equal in magnitude and opposite in direction to the outward force component. Such language is intended to account for the fact that the outward force changes over a certain period of time and so does the inward force change over a certain period of time. By referring to the outward and inward forces in such manner, applicant intends to include rate of change of the forces.

The extendable link means may include a variety of extendable links 40 as shown in FIGS. 11–14. The extendable link means may comprise elastic cord 85, elastic hose 86, helical spring 87 and/or telescopic member 88. In another preferred embodiment of this invention, the extendable link means includes cable 89 which is wound around cable recoiler 90 which is spring loaded, as shown in FIG. 15. Cable 89 and cable recoiler 90 will cause extendable link 40 to function similar to those embodiments shown in FIGS. 11–14. It is apparent that the extendable link means may include at least one, possibly two or more, extendable links 40. It is also apparent that any combination of extendable links 40, as shown in FIGS. 11–14, can be used. Cable recoiler 90, as shown in FIG. 15, has a base which is preferably attached to a rotational device for providing full pivotal movement in 3 directions.

Figures 4, 5, 6, 7, 8, 9, 10, 10A, 22:
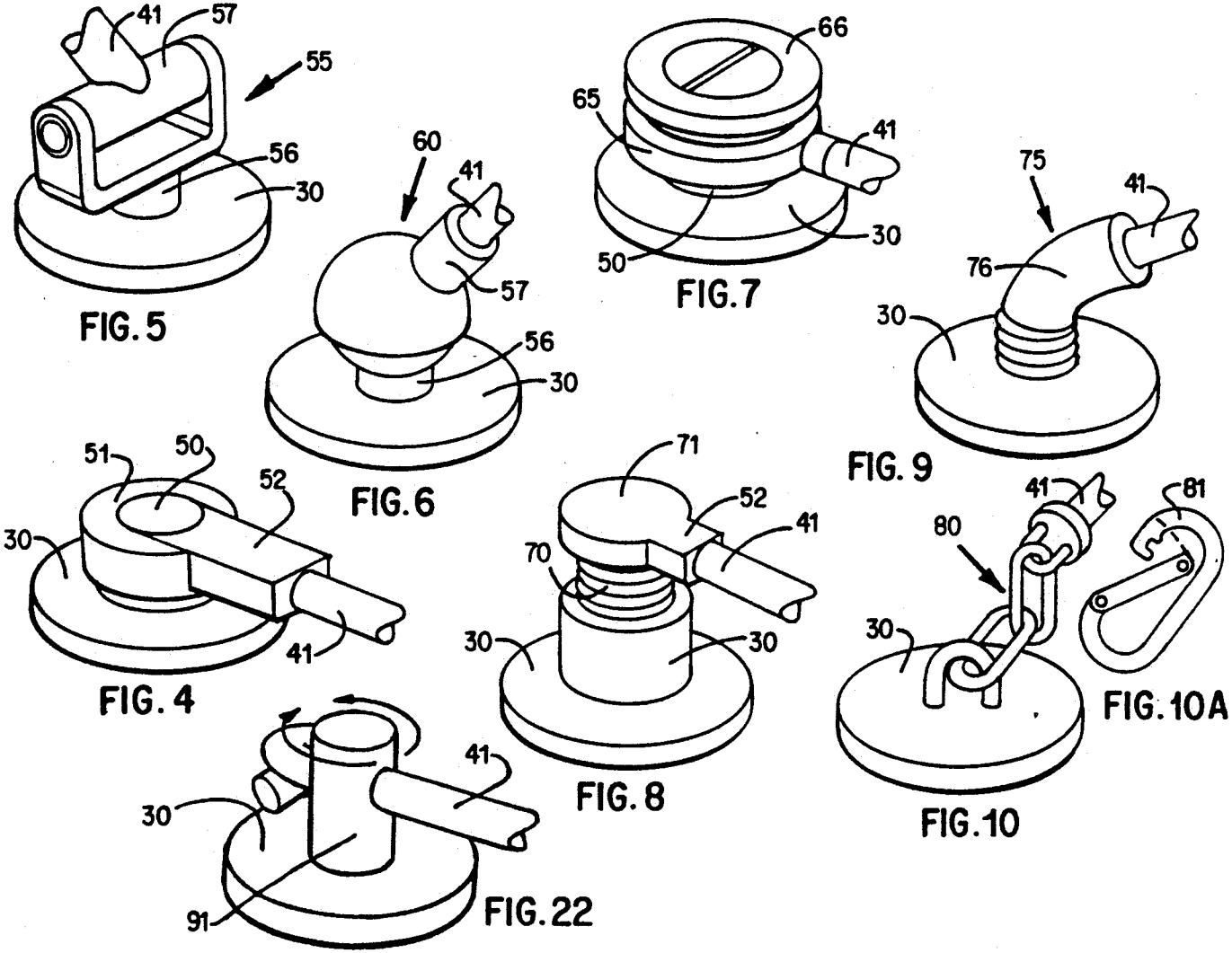
FIGS. 4–10 are perspective views of different embodiments of the pivotal connection between the base and the extendable link.
FIG. 10A shows a carabiner which is used to attach the chain shown in FIG. 10.
FIG. 22 is a perspective view of yet another preferred embodiment of the pivotal connection between the base and the extendable link.
Figures 11, 12, 13, 14, 15:
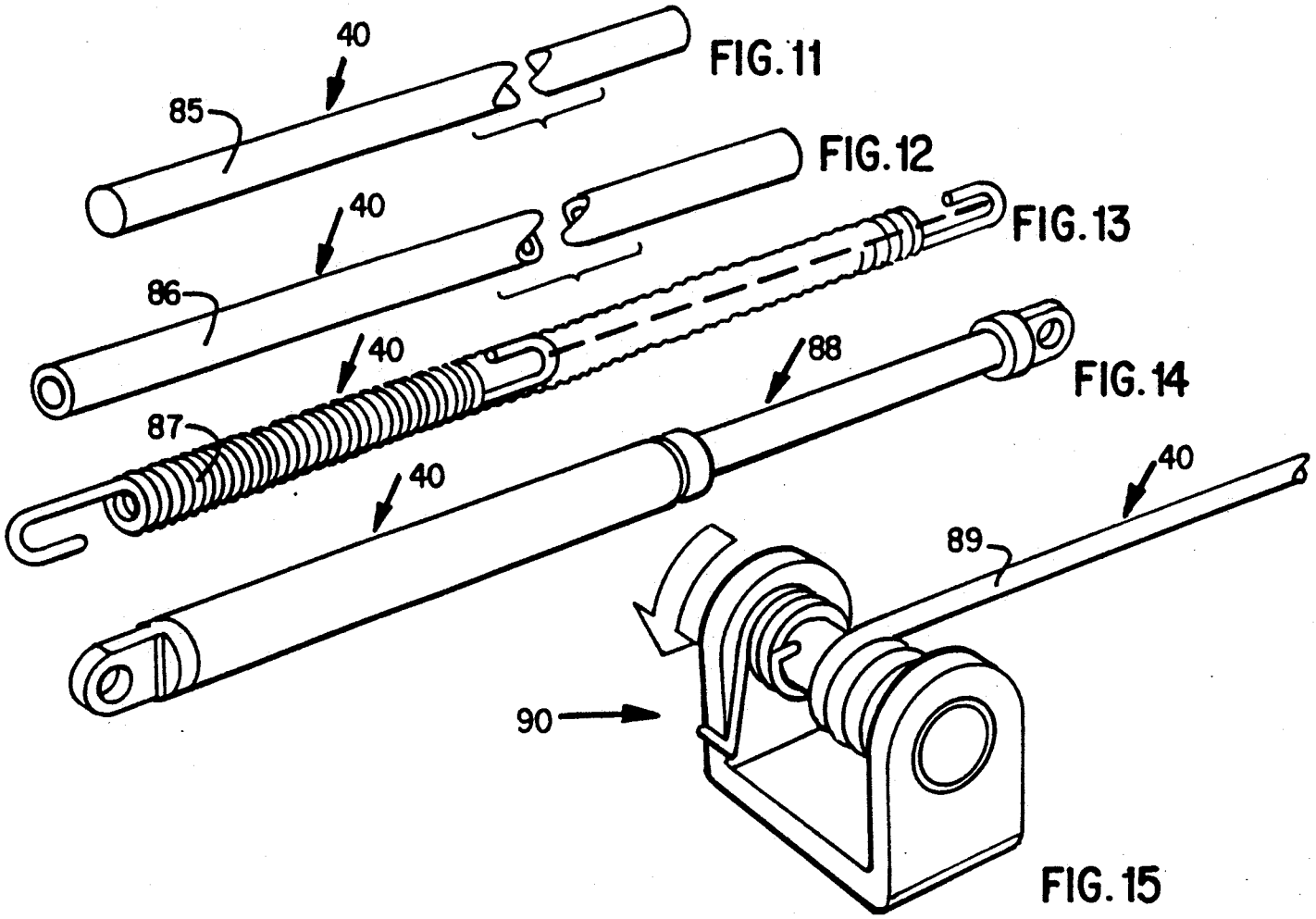
FIGS. 11–15 are perspective views of different embodiments of the extendable link of this invention.

The pivotal connection means is used to pivotally attach extendable link 40 to the base. Several different preferred embodiments of the pivotal connection means are shown in FIGS. 4–10. FIG. 4 shows the pivotal connection means having shaft 50 secured to base 30 in any suitable manner known in the art. Rotor 51 is rotatably mounted on shaft 50. Base end 41 of extendable link 40 is secured to extension member 52 of rotor 51. It is apparent that in each embodiment of the pivotal connection means, extendable link 40 can be either fixedly secured, pivotally attached, or rotatably attached with respect to the pivotal connection means.

FIG. 5 shows another embodiment of the pivotal connection means where universal joint 55 has base shaft 56 secured to base 30. Link shaft 57 is attached to base end 41 of extendable link 40. FIG. 6 shows another embodiment in which the pivotal connection means includes ball joint 60. Base shaft 56 of ball joint 60 is secured to base 30. Link shaft 57 of ball joint 60 is attached to base end 41 of extendable link 40.

FIG. 7 shows another embodiment of the pivotal connection means in which shaft 50 is secured to base 30. Ring 65 is positioned over shaft 50 and ring 65 is rotatable with respect to base 30. Base end 41 of extendable link 40 is attached to ring 65. Ring 65 is retained on shaft 50 by ring retaining means which in one preferred embodiment includes cap 66 threadedly secured to shaft 50. It is apparent that cap 66 can be replaced by an other retaining means familiar to those skilled in the art.

FIG. 8 shows a preferred embodiment of the pivotal connection means in which extendable link 40 is attached at base end 41 to extension member 52 of top 71. Top 71 is secured to one end of coil spring 70. The opposite end of coil spring 70 is secured to base 30. Such embodiment provides pivotal movement of extendable link 40 with respect to base 30. It is apparent that coil spring 70 can be replaced with a threaded shaft which mates with a threaded coupling of base 30. It is also apparent that coil spring 70 can be replaced with a threaded coupling which mates with a threaded shaft attached to base 30. Such threaded connection provides rotational movement of extendable link 40, with respect to base 30. Extendable link 40 provides additional freedom to make the movement pivotal. Throughout this application, the term "pivotal connection means" is intended to include rotational movement as well as vertical displacement of extendable link 40 with respect to base 30.

FIG. 9 shows another embodiment of the pivotal connection means in which flexible stem means have one end secured to base 30 and an opposite end attached to base end 41 of extendable link 40. The flexible stem means can include a flexible tube, a flexible rod, a flexible knob or any other suitable flexible stem known to those skilled in the art. It is apparent that the flexible stem is not limited to a tubular shape but can be any other suitably shaped stem that provides the desired flexibility.

FIG. 10 shows yet another embodiment of the pivotal connection means having one end of chain 80 secured to base 30 and an opposite end of chain 80 attached to base end 41 of extendable link 40. FIG. 10A shows carabiner 81 which can be used to quickly connect and disconnect chain 80 from either base 30 or base end 41 of extendable link 40.

FIG. 22 shows still another embodiment of the pivotal connection means in which base end 41 of extendable link 40 is secured with respect to post 91 by base end 41 being positioned within a through hole within post 91. As shown in FIG. 22, base end 41 extends through the through hole within post 91 and is tied in a knot at its end so that base end 41 does not pull out of the through hole when a axial force is applied to extendable link 40. Post 91 is rotatably attached with respect to base 30 as indicated by the arrows in FIG. 22. It is apparent that post 91 can be rotatably attached with respect to base 30 in any manner known to those skilled in the art.

Figures 16, 17, 18, 19, 20, 21:
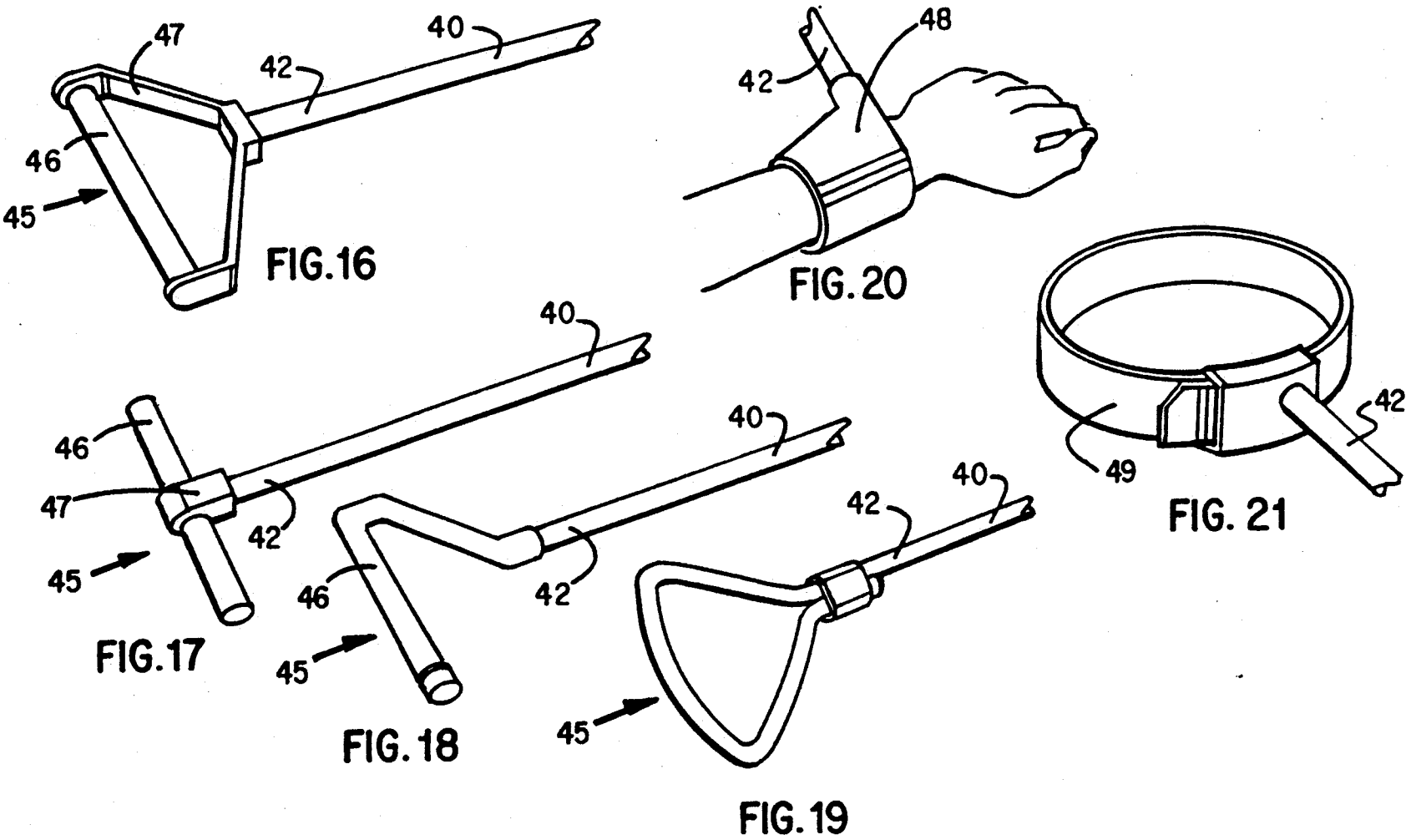
FIGS. 16–19 are perspective views of different embodiments of handles according to this invention.
FIG. 20 is a perspective view of a wristband according to one embodiment of this invention.
FIG. 21 is a perspective view of a waistband according to one embodiment of this invention.

The grasping means of this invention are used by the person for holding onto extendable link 40. Different preferred embodiments of the grasping means are shown in FIGS. 16–21. FIG. 16 shows handle 45 comprising bracket 47 which is attached to grasping end 42 of extendable link 40. Rod 46 is secured between two ends of bracket 47. FIG. 17 shows another embodiment of the grasping means in which handle 45 comprises a T-handle with bracket 47 attached to grasping end 42 of extendable link 40. FIG. 18 shows another preferred embodiment of a handle, similar to the embodiment shown in FIG. 17. FIG. 19 shows extendable link 40 looped at grasping end 42 to form handle 45.

FIG. 20 shows another preferred embodiment of the grasping means in which wristband 48 is attached to grasping end 42 of extendable link 40. FIG. 21 shows yet another preferred embodiment of the grasping means in which waistband 49 is attached to grasping end 42.

It is apparent that multiple persons can use the apparatus according to this invention. FIG. 3 shows one preferred embodiment of the recreational apparatus according to this invention, which is set up for two users. FIG. 3 shows one base 30, one shaft 50, two rotors 51, and two extendable links 40. Each extendable link 40 is attached to a corresponding extension member 52 at base end 41. It is apparent that extendable link 40 can include an elastic link such as elastic cord 85 and/or elastic hose 86, or any other extendable link 40 as described above.

According to still another preferred embodiment of this invention, as shown in FIGS. 23-30, the recreational apparatus of this invention can be used without having an end of the extendable link secured with respect to a base. According to the preferred embodiment shown in FIGS. 23-30, multiple users, preferably two users, can use the apparatus to propel themselves with respect to each other, rather than with respect to ground. In such preferred embodiment of this invention, the recreational apparatus can be used between two or more persons rollerblading, roller skating, skateboarding, ice skating, and the like.

Figures 23, 24, 25, 26, 27:
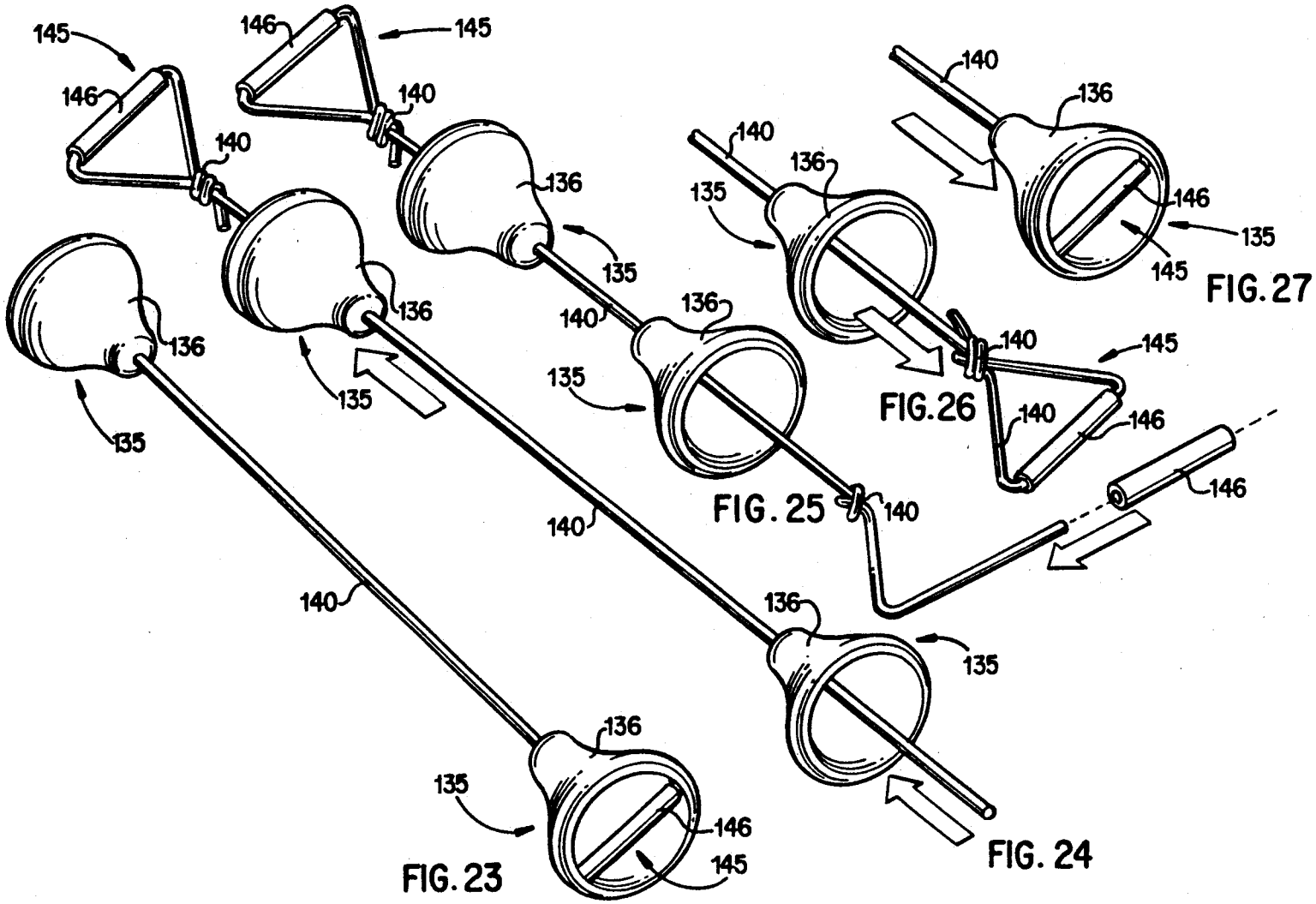
FIG. 23 is a perspective view of an assembled recreational apparatus for propelling two persons with respect to each other, according to yet another preferred embodiment of this invention.
FIGS. 24–27 are perspective views of the recreational apparatus of FIG. 23, showing how a shield and handle are assembled on an extendable link.

Referring to the perspective view of the recreational apparatus as shown in FIG. 23, two users each grab an opposite end of extendable link 140. Each user grasps extendable link 140 at handle 145. During operation of the recreational apparatus, a first user accelerates with respect to a second user with a transfer of energy through extendable link 140. For example, two persons rollerblading with the recreational apparatus of this invention would begin by having a first user accelerate with respect to a second user. During acceleration, extendable link 140 stretches into a tension position. Once extendable link 140 is extended into a tension position, the second user could then use the energy resulting from the return force of extendable link 140 to then accelerate with respect to the first user. This process could continue as both users skate at a certain velocity. It is also apparent that various skating maneuvers and tricks can be performed while one user is either in a stationary position or a moving position.

According to one preferred embodiment of this invention, extendable link 140 is capable of extending outward upon application of a tension force, and is also capable of returning to its original or rest position upon release of the tension force. It is apparent that extendable link 140 can be an elastic cord, a rubber hose, or any other suitable elongated member which has elastic stretching and returning properties.

The recreational apparatus according to this preferred embodiment of this invention also comprises grasping means for attaching a user's limb 132 with respect to extendable link 140. The grasping means are secured to extendable link 140 at each of the opposite ends of extendable link 140.

According to one preferred embodiment of this invention, the grasping means comprise handle 145, as shown in FIGS. 23-29. FIGS. 24-27 show the various steps involved with assembling handle 145, according to one preferred embodiment of this invention. As shown in FIG. 25, extendable link 140 is tied into a first knot. Rod 146 has a longitudinal through hole and extendable link 140 is positioned within such through hole, as shown in FIG. 25. As shown in FIG. 26, extendable link 140 is tied into a second knot upon itself, at the same location of the first knot, to form a loop with an extendable link 140 which contains rod 146. As shown in FIG. 26, such construction results in a practical and inexpensive grasping means. However, it is apparent that the grasping means shown in FIGS. 16-21 also provide suitable handles for use with the recreational apparatus of this preferred embodiment, as shown in FIGS. 23-30.

According to another preferred embodiment of this invention, the recreational apparatus further comprises protection means for protecting limb 132 from contact with the grasping means, or handle 145 for example, upon release of one end of extendable link 140, when extendable link 140 is stretched into a tension position. It is apparent that during use of the recreational apparatus according to this preferred embodiment, one user may intentionally or unintentionally release the grasping means when extendable link 140 is in a state of tension. The net effect of such action could result in one end of extendable link 140 and one grasping means being launched at the user that remains attached to the recreational apparatus. Protection means 135 provide a safety measure for avoiding contact between limb 132 and the grasping means, or handle 145 for example.

Figure 28:
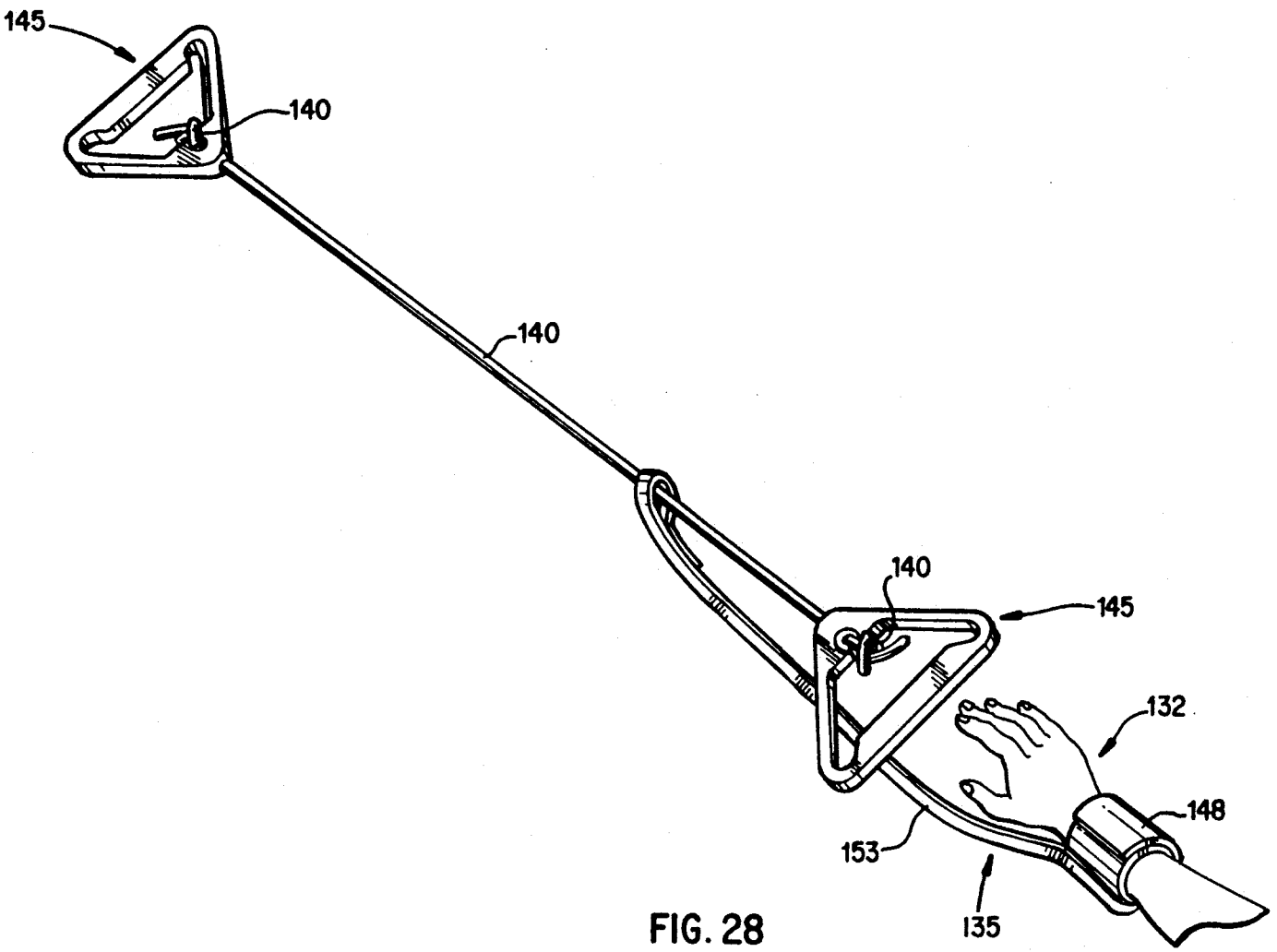
FIG. 28 is a perspective view of a recreational apparatus, according to another preferred embodiment of this invention, having a wristband connected to the extendable link with a flexible link.

According to one preferred embodiment of this invention, protection means 135 comprise shield 136 which is mounted on extendable link 140, preferably between the opposite ends of extendable link 140. As shown in FIGS. 23-27, shield 136 has a through hole within which extendable link 140 is positioned. Shield 136 may comprise any suitable material, such as a foam material, a synthetic material or any other suitable material that is preferably lightweight and inexpensive. According to another preferred embodiment of this invention as shown in FIG. 28, protection means 135 comprise safety link 153. Safety link 153 preferably has one end attached to extendable link 140 and an opposite end attached to limb 132, in any suitable manner known to those skilled in the art. As shown in FIG. 28, safety link 153 is attached to wrist strap 148.

As shown in FIG. 28, limb 132 comprises a user's arm and hand. However, it is apparent that limb 132 may comprise any other suitable portion of the user's body, or another piece of clothing or another apparatus attached with respect to the user's body.

Figure 30:
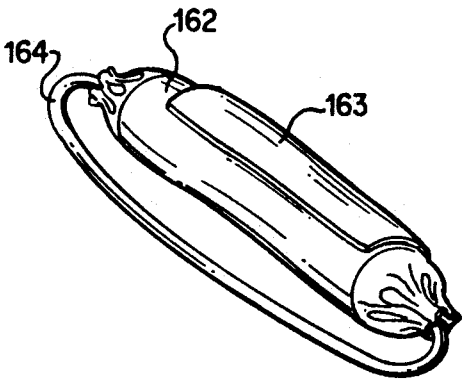
FIG. 30 is a perspective view of the recreational apparatus of FIG. 29 in a storage container.
Figure 29:
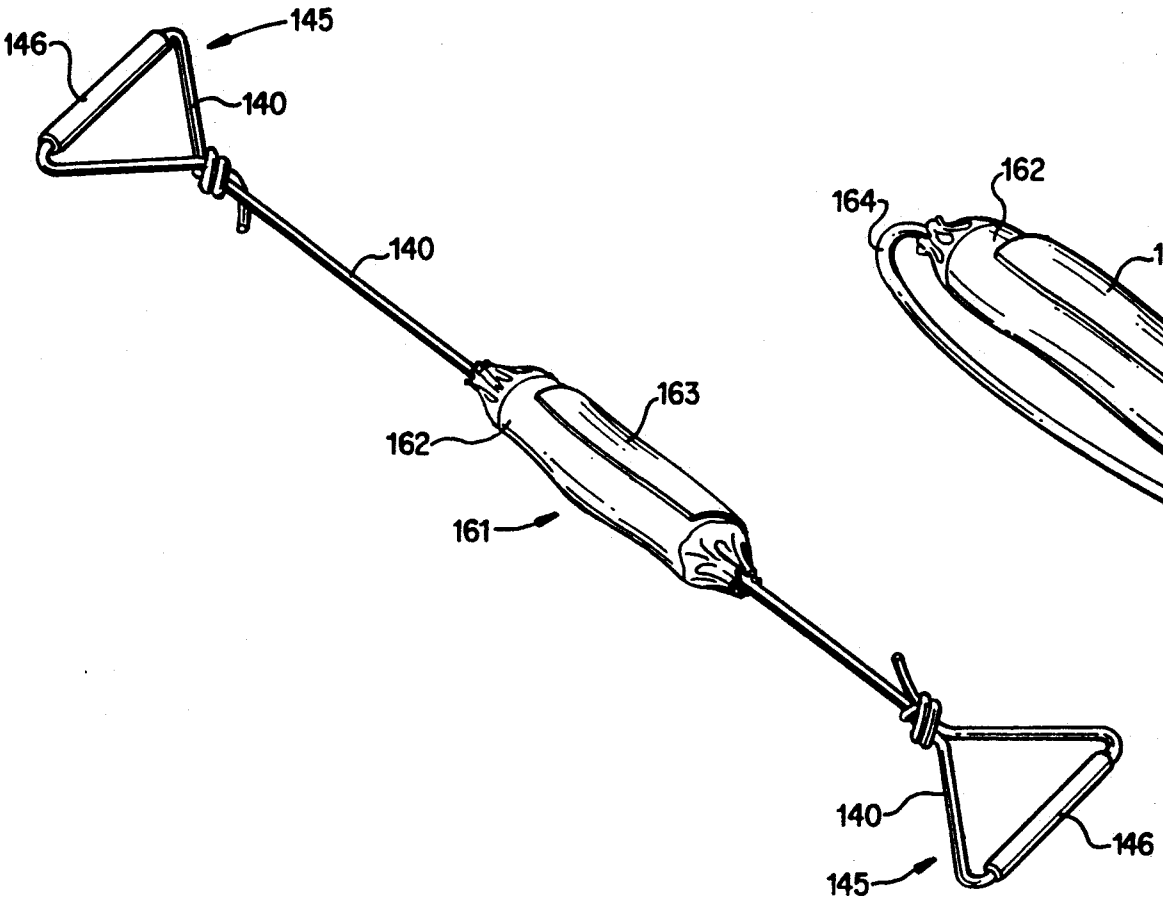
FIG. 29 is a perspective view of a recreational apparatus, according to still another preferred embodiment of this invention, having a storage container attached to the extendable link.

FIGS. 29 and 30 show yet another preferred embodiment according to this invention. In such preferred embodiment, the recreational apparatus further comprises storage means for storing the grasping means or other accessories, such as gloves and other personal items. As shown in FIG. 30, the recreational apparatus, including the grasping means and a major portion of extendable link 140, are enclosed within pouch 162. Pouch handle 164 may be formed by either a portion of extendable link 140 or by an independent handle constructed of a suitable material, depending upon the particular design of pouch 162. Also as shown in FIGS. 29 and 30, pouch 162 comprises lid 163, which may be attached by any suitable fastening means known to those skilled in the art.

Referring to FIG. 29, extendable link 140 preferably extends through pouch 162. Pouch 162 is preferably mounted around a portion of extendable link 140. It is apparent that pouch 162 can either be mounted to freely slide along extendable link 140 or can be mounted such that it is secured with respect to extendable link 140.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention

I claim:

1. A recreational apparatus comprising:

an extendable link capable of stretching outward upon application of a tension force and capable of returning to a rest position upon release of said tension force;

grasping means for attaching a limb with respect to said extendable link, said grasping means secured to said extendable link at opposite ends of said extendable link; and storage means for storing at least one of said grasping means and accessories, said storage means comprising a storage container mounted on said extendable link between said opposite ends, and said storage container comprising a piece of material forming a pouch with an opening and a closeable lid for covering said opening.

2. A recreational apparatus according to claim 1 wherein said grasping means comprise a handle.

3. A recreational apparatus according to claim 2 wherein said handle comprises a tubular member having a longitudinal through hole and said extendable link is positioned within said through hole.

4. A recreational apparatus according to claim 1 wherein said grasping means comprise said extendable link forming a loop at one of said opposite ends.

5. A recreational apparatus according to claim 4 wherein said loop is formed by said extendable link being tied in a knot upon itself.

6. A recreational apparatus according to claim 1 further comprising protection means for protecting said limb from contact with said grasping means upon release of one end of said extendable link when said extendable link is stretched into a tension position.

7. A recreational apparatus according to claim 6 wherein said protection means comprise a shield mounted on said extendable link between said opposite ends of said extendable link.

8. A recreational apparatus according to claim 6 wherein said protection means comprise a flexible link with one end attached to said extendable link and an opposite end attachable to said limb.

* * * * *